US009881724B2

(12) United States Patent
Hirata et al.

(10) Patent No.: US 9,881,724 B2
(45) Date of Patent: Jan. 30, 2018

(54) REACTOR

(71) Applicants: TOYOTA JIDOSHA KABUSHIKI KAISHA, Aichi-ken (JP); TOKAI KOGYO CO., LTD., Obu, Aichi-pref. (JP)

(72) Inventors: Shuichi Hirata, Nisshin (JP); Nobuki Shinohara, Toyota (JP); Takeshi Okada, Aichi-ken (JP); Yoshikazu Kamikawa, Okazaki (JP); Kazuo Hirasawa, Iida (JP)

(73) Assignees: TOYOTA JIDOSHA KABUSHIKI KAISHA, Toyota-shi, Aichi-ken (JP); TOKAI KOGYO CO., LTD., Obu, Aichi-pref. (JP)

( * ) Notice: Subject to any disclaimer, the term of this patent is extended or adjusted under 35 U.S.C. 154(b) by 310 days.

(21) Appl. No.: 14/780,644

(22) PCT Filed: Mar. 27, 2014

(86) PCT No.: PCT/IB2014/000440
§ 371 (c)(1),
(2) Date: Sep. 28, 2015

(87) PCT Pub. No.: WO2014/155187
PCT Pub. Date: Oct. 2, 2014

(65) Prior Publication Data

US 2016/0055953 A1 Feb. 25, 2016

(30) Foreign Application Priority Data

Mar. 28, 2013 (JP) ..... 2013-069777

(51) Int. Cl.
*H01F 27/02* (2006.01)
*H01F 27/28* (2006.01)
(Continued)

(52) U.S. Cl.
CPC ..... *H01F 27/022* (2013.01); *H01F 27/306* (2013.01); *H01F 27/327* (2013.01)

(58) Field of Classification Search
USPC ..... 336/96, 216, 220, 184, 90, 83
See application file for complete search history.

(56) References Cited

U.S. PATENT DOCUMENTS 4,631,509 A * 12/1986 Arii ..... H01F 27/06 336/197
8,749,335 B2 * 6/2014 Ueno ..... H01F 37/00 336/178
(Continued)

FOREIGN PATENT DOCUMENTS

CN 102237171 A 11/2011
JP 05-066950 U 9/1993
(Continued)

*Primary Examiner* — Tsz Chan
*Assistant Examiner* — Kazi Hossain
(74) *Attorney, Agent, or Firm* — Sughrue Mion, PLLC

(57) ABSTRACT

A reactor 2 disclosed by the present specification is equipped with two coils 3 that are arranged parallel to each other, a resin cover 41 that adheres to the two coils to cover the coils, and a column member 13. The resin cover 41 exposes lateral faces of the coils on such a side as to be in contact with a common tangential plane KL. The column member 13 is arranged parallel to the coils 3 in a space that is surrounded by the common tangential plane KL and the lateral faces of the respective coils 3. The column member 13 is exposed on a side thereof that is opposed to the common tangential plane KL, and is in contact with the respective coils 3 on the other side thereof. Furthermore, the column member 13 has a groove 13*a* that has an opening on the other side of the common tangential plane KL and extends along coil axes. The groove has a width that is narrow at the opening and widens toward a bottom of the groove. An interior of the groove is filled with resin of the resin cover 41.

4 Claims, 4 Drawing Sheets

(51) Int. Cl.
*H01F 27/30* (2006.01)
*H01F 27/32* (2006.01)

(56) References Cited

U.S. PATENT DOCUMENTS

| | | | | |
|---|---|---|---|---|
| 9,183,981 | B2 * | 11/2015 | Ueno | H01F 37/00 |
| 9,343,212 | B2 * | 5/2016 | Shinohara | H01F 27/022 |
| 9,478,346 | B2 * | 10/2016 | Nakata | H01F 27/06 |
| 2011/0234359 | A1 * | 9/2011 | Ono | H01F 27/306<br>336/216 |
| 2012/0092120 | A1 * | 4/2012 | Yoshikawa | H01F 27/022<br>336/220 |
| 2013/0314964 | A1 * | 11/2013 | Yoshikawa | H01F 37/00<br>363/131 |

FOREIGN PATENT DOCUMENTS

| | | | |
|---|---|---|---|
| JP | 2009-246222 | A | 10/2009 |
| JP | 2011-198970 | A | 10/2011 |
| JP | 2011-249427 | A | 12/2011 |

* cited by examiner

REACTOR

BACKGROUND OF THE INVENTION

1. Field of the Invention

The invention relates to a reactor. The reactor is a passive element that utilizes a coil, and may also be referred to as "an inductor".

2. Description of Related Art

A reactor is equipped with a core as a magnetic body, and a coil that is wound around the core. In some cases, the reactor is designed to have a bobbin that retains the coil. In many cases, the reactor is often covered with resin for the purpose of being insulated or protected against physical contact with other devices (e.g., Japanese Patent Application Publication No. 2011-249427 (JP-2011-249427 A), Japanese Patent Application Publication No. 2009-246222 (JP-2009-246222 A); and Japanese Utility Model Application Publication No. 05-066950 (JP-05-066950 U).

In a motor drive system of each of electric vehicles including hybrid vehicles, a reactor may be employed in a circuit of a voltage converter or the like. The reactor for electric vehicles allows a large current to flow therethrough, and hence generates a large quantity of heat. Technologies for efficiently cooling the reactor have been desired. In each of Japanese Patent Application Publication No. 2011-249427 (JP-2011-249427 A) and Japanese Patent Application Publication No. 2009-246222 (JP-2009-246222 A), there is disclosed a reactor having coils wound around parallel regions of ring-shaped cores respectively, as a reactor suited for electric vehicles. As a measure against heat, in the art of Japanese Patent Application Publication No. 2011-249427 (JP-2011-249427 A), the cores and the coils are entirely covered with resin, but the coils are partially exposed, and a radiator plate is placed against the coils at the exposed portions of the coils. In the art of Japanese Patent Application Publication No. 2009-246222 (JP-2009-246222 A), when viewed from an axial direction of the coils, the two coils are about half covered with resin with a plane passing two axes of the coils regarded as a border, to secure a strength, and the other halves are exposed to promote heat radiation in the exposed regions.

SUMMARY OF THE INVENTION

In each of the arts of Japanese Patent Application Publication No. 2011-249427 (JP-2011-249427 A) and Japanese Patent Application Publication No. 2009-246222 (JP-2009-246222 A), the coils are covered with resin, but are partially exposed. For the sake of explanation, a resin component that covers the coils is referred to as a resin cover. In many cases, the resin cover is made according to an injection mold method in order to protect the coils and maintain the shape thereof. More specifically, an assembly of the coils and the cores is put into a mold, and molten resin is injected. The mold is made of metal. On the other hand, the coils have windings wound therearound. Therefore, the contour of the coils does not exhibit high accuracy, and gaps may be formed between the metallic mold and the coils. If gaps are formed in contact regions between the mold and the coils, molten resin leaks, so that the area of the regions of the coils to be intrinsically exposed may become small. In particular, in the case where the two coils are arranged parallel to each other and lateral faces of the coils are exposed on such a side as to be in contact with a common tangential plane, resin may leak out to the regions to be intrinsically exposed from between the adjacent coils. This is because it is difficult to appropriately place the mold against both the adjacent coils and strictly close a border that defines a space (i.e., a cavity) to be filled with resin, between the adjacent coils.

The art disclosed by the present specification provides a reactor in which coil exposed regions of a resin cover that covers coils are appropriately secured.

The reactor disclosed by the present specification is equipped with a resin cover that adheres to two coils to cover the coils. The resin cover exposes lateral faces of the respective coils on such a side as to be in contact with a common tangential plane. In the art disclosed by the present specification, a column member is arranged in advance separately from injection-molded resin, in regions that are equivalent to borders between the resin cover and the lateral faces to be intrinsically exposed, in a space that is surrounded by the common tangential plane and the lateral faces of the respective coils. The column member is exposed on a side opposed to the common tangential plane, and is in contact with the respective coils on the other side. The column member prevents molten resin from leaking out along the lateral faces of the coils, instead of a mold during injection molding. Furthermore, the column member is provided with a groove that has an opening on the other side of the common tangential plane and extends along axes of the coils, such that the column member adheres to the lateral faces of the coils during injection molding. A width of the groove widens from the opening toward a bottom of the groove. During injection molding, an interior of the groove is filled with resin of the resin cover, but molten resin applies a pressure in such a manner as to press lateral walls of the groove outward inside the groove. The pressure serves as a force that causes outer sides of the lateral walls of the groove to adhere to the lateral faces of the coils respectively. Therefore, the column member adheres well to the lateral faces of the coils, and prevents molten resin from leaking from between the lateral faces of the coils and the column member. Incidentally, it is preferable that the column member be made of resin instead of being made of metal so as to adhere well to the lateral faces of the coils. Furthermore, in order to make it easy for molten resin to flow into the groove during injection molding, it is appropriate that a gate (a resin injection hole for molten resin) that is provided through a cavity face of the mold be oriented toward the groove. In the finished reactor, a gate trace is located in a direction in which the opening of the groove of the column member is oriented.

Incidentally, the resin cover exposes the lateral faces of the respective coils on such a side as to be in contact with the common tangential plane. However, other regions of the coils may be exposed. The details, and further improvements of the art disclosed by the present specification will be described in the following "DETAILED DESCRIPTION OF EMBODIMENTS".

BRIEF DESCRIPTION OF THE DRAWINGS

Features, advantages, and technical and industrial significance of an exemplary embodiment of the invention will be described below with reference to the accompanying drawings, in which like numerals denote like elements, and wherein.

DETAILED DESCRIPTION OF EMBODIMENT

Figure 1:
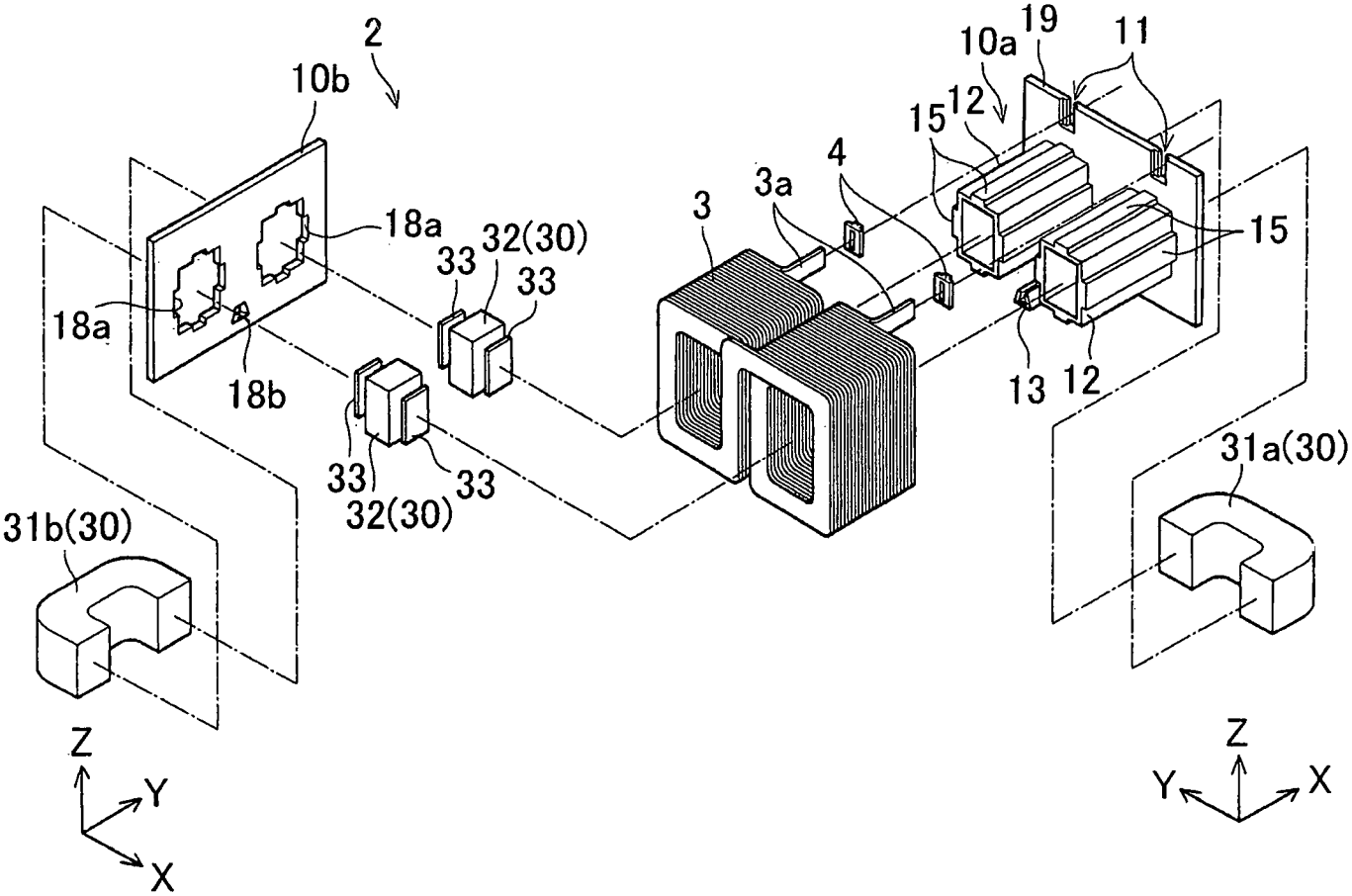
FIG. 1 is an exploded perspective view of a reactor according to the embodiment of the invention.
Figure 2:
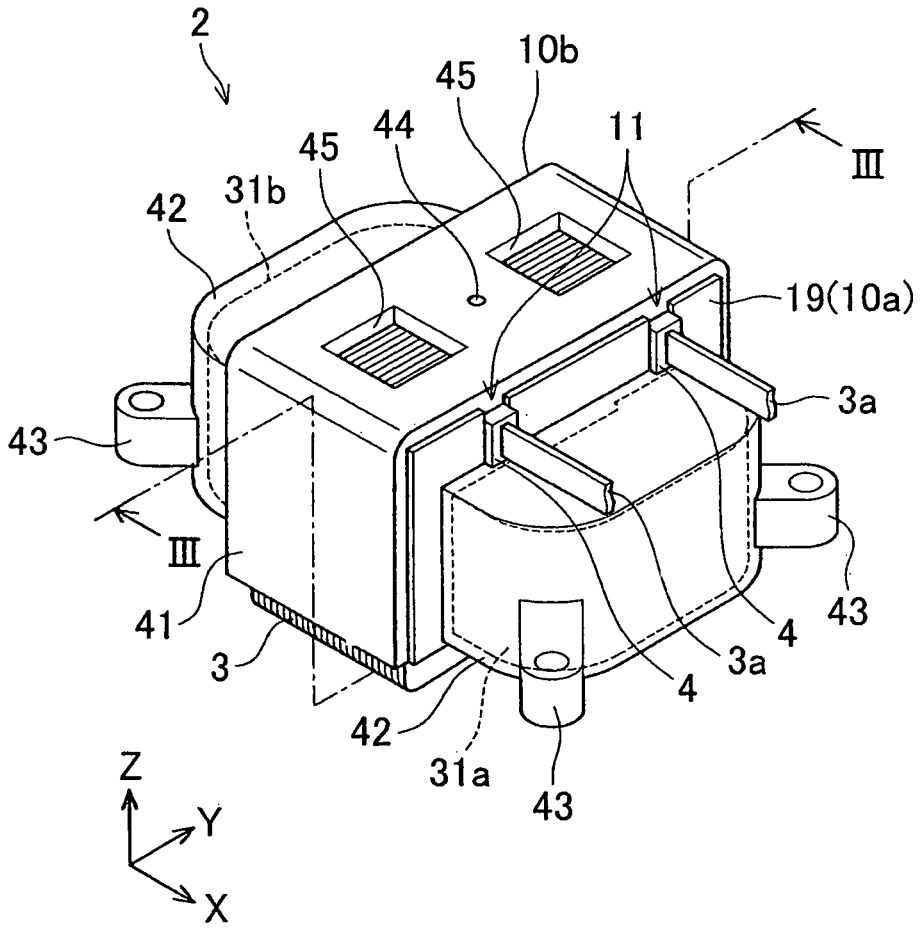
FIG. 2 is a perspective view of the reactor.

Referring to the drawings, a reactor according to the embodiment of the invention will be described. FIG. 1 is an exploded perspective view showing a reactor 2 before injection molding (before resin molds are molded on parts of surfaces of coils). FIG. 2 is a perspective view showing the reactor 2 after injection molding, namely, the finished reactor 2. The reactor 2 is employed in, for example, a converter that steps up a battery voltage to a voltage suited to drive a motor in an electric vehicle. The reactor 2 is designed for large current, has a permissible current value equal to or larger than 100 (A), and uses rectangular wires as windings of coils. The rectangular wires are conducting wires with a rectangular cross-section, and have a small electric resistance. In the reactor 2, the rectangular wires are wound with wide faces thereof oriented in a longitudinal direction of the coils. In other words, the rectangular wires are wound with narrow faces thereof oriented in a radial direction of the coils. Such a winding pattern is referred to as edgewise winding or longitudinal winding.

Referring to the exploded view of FIG. 1, an overall structure of the reactor 2 will be outlined. The reactor 2 is equipped, as its main components, with double-barrel coils 3 that are electrically connected in series to each other and physically arranged such that coil axes thereof extend parallel to each other, a bobbin 10 (10*a* and 10*b*) that is inserted through the coils 3, and ring-shaped cores 30 that pass inside tubes of the bobbins 10 respectively. Incidentally, the direction in which the coil axes extend is equivalent to a direction in which an X-axis extends in the drawing. Besides, it should be noted in FIG. 1 that the right and left sides of the drawing are depicted from different viewpoints for the sake of easy understanding (see two coordinate systems in the drawing).

The ring-shaped cores 30 are constituted by a pair of U-shaped cores 31*a* and 31*b* and two I-shaped cores 32. Both the cores are obtained by sintering ferrite particles coated with an insulating material together with resin. The pair of the U-shaped cores 31*a* and 31*b* are arranged with end faces thereof facing each other. The I-shaped cores 32 are arranged between the end faces of the pair of the U-shaped cores 31*a* and 31*b*. The two I-shaped cores 32 that are arranged parallel to each other constitute parallel regions in the ring-shaped cores. Spacer plates 33 are arranged between the end faces of the U-shaped cores 31*a* and 31*b* and the I-shaped cores 32 respectively. The spacer plates 33 are made of ceramics.

The bobbin 10 is divided into two parts, namely, a first part 10*a* and a second part 10*b* in the direction of the coil axes. The first part 10*a* has a structure in which two tube portions 12 are fixed to a flange 19 so as to be parallel to each other in accordance with the double-barrel coils 3. The coils 3 are formed by winding rectangular wires into a substantially rectangular shape, and the tube portions 12 are also substantially rectangular. The flange 19 defines one end of a coil winding range.

The second part 10*b* is equivalent to the other flange. Accordingly, the second part 10*b* may be referred to as the flange 10*b* in the following description. The flange 10*b* is provided with fitting holes 18*a* in which the two tube portions 12 that extend from the flange 19 of the first part 10*a* are fitted respectively. A column member 13 extends from the flange 19 parallel to the tube portions 12. The flange 10*b* is provided with a fitting hole 18*b* in which a tip of the column member 13 is fitted. The column member 13 and the fitting hole 18*b* will be described later.

The coils 3 are formed by winding rectangular wires in a substantially rectangular shape, and the tube portions 12 are also substantially in the shape of a quadratic prism. The double-barrel coils 3 are passed through the two tube portions 12 respectively, and the I-shaped cores 32 and the spacer plates 33 are inserted into the tube portions 12 respectively. Then, when the second part 10*b* is fitted to tips of the tube portions 12, the bobbin 10 is finished, and a unit having the double-barrel coils 3 that are parallel to each other and wound between the two flanges 19 and 10*b* of the bobbin is finished. When the U-shaped cores 31*a* and 31*b* are inserted from both sides of the bobbin respectively, an assembly of the reactor 2 except a resin cover is finished. In the assembly of the reactor 2, the coils 3 are wound around the parallel regions of the ring-shaped cores 30 respectively. Besides, the pair of the flanges 19 and 10*b* define a winding range of the coils.

Incidentally, the tube portions 12 of the bobbin are substantially in the shape of a quadratic prism as described above. Convex streaks 15 are provided on four lateral faces of each of the tube portions 12 respectively. Head faces of the ridges 15 abut on inner faces of the coils 3 respectively. At a stage where the coils 3 are passed through the cores 30 respectively, gaps are created beside the ridges 15 respectively. However, the gaps are filled with resin of the resin cover during injection molding of the resin cover (which will be described later).

The flange 19 as one of the flanges is provided with slits 11 through which lead portions 3*a* of the coils 3 pass respectively. The lead portions 3*a* pass through the slits 11 respectively, but small plates 4 are arranged between the slits 11 and the lead portions 3*a* respectively. The small plates 4 are provided with holes, through which the lead portions 3*a* are passed respectively. Steps are provided around the small plates 4 respectively, and those step regions engage steps that are provided in the slits 11 respectively. The small plates 4 are constituted of small-diameter portions and large-diameter portions across the steps respectively. The large-diameter portions are opposed to the coils 3 respectively, and the small-diameter portions are located on the other side of the coils 3 respectively. The holes of the small plates 4 are so dimensioned as to be closely fitted to the lead portions 3 *a* respectively. Peripheries of the lead portions 3*a* are sealed by the small plates 4 respectively. Besides, the large-diameter portions of the small plates 4 abut on peripheral edges of the slits 11 from the coil sides respectively, thus closing up the slits respectively. As will be described later, the coils 3 are molded by resin between the pair of the flanges 19 and 10*b*. However, when the reactor 2 before injection molding is put into a mold to inject resin between the pair of the flanges 19 and 10*b*, the small plates 4 prevent resin from leaking from between the slits 11 and the lead portions 3*a* respectively.

FIG. 2 is a perspective view showing the reactor 2 after injection molding, namely, the finished reactor 2. The coils 3 are molded by resin (covered with resin) between the pair of the flanges 19*a* and 10*b*. The resin cover that covers the coils 3 is denoted by a reference numeral 41. However, the resin cover 41 has windows 45 above, and the coils 3 are partially exposed from the windows respectively. Besides, lower sides of the coils 3 are also exposed from the resin cover 41. The coils have a substantially rectangular cross-section, and the exposed regions of the lower sides thereof are those of the rectangular lateral faces of the two coils which are oriented in the same direction. In other words, those faces are the lateral faces of the respective coils on such a side as to be in contact with a common tangential plane.

A gate trace is denoted by a reference numeral 44. The gate trace is equivalent to a resin injection hole that is provided through a cavity face of a mold when the reactor before injection molding is put in the mold.

The resin cover 41 covers up to about half of a thickness of the flange 19 on the coil sides. As described above, the slits 11 for drawing out the lead portions, which are formed through the flange 19, are sealed by the small plates 4 respectively. Therefore, resin, does not leak from between the slits 11 and the lead portions 3*a*.

In the reactor 2, the U-shaped cores 31*a* and 31*b* are also covered with resin outside the flange 19 (the second part 10*b*) (on the other side of the coils 3). A resin cover that covers the cores is denoted by a reference numeral 42. The resin cover 42 has fixation ribs 43 for fixing the reactor 2 to a housing. The resin cover 42 is also manufactured through injection molding.

Figure 3:
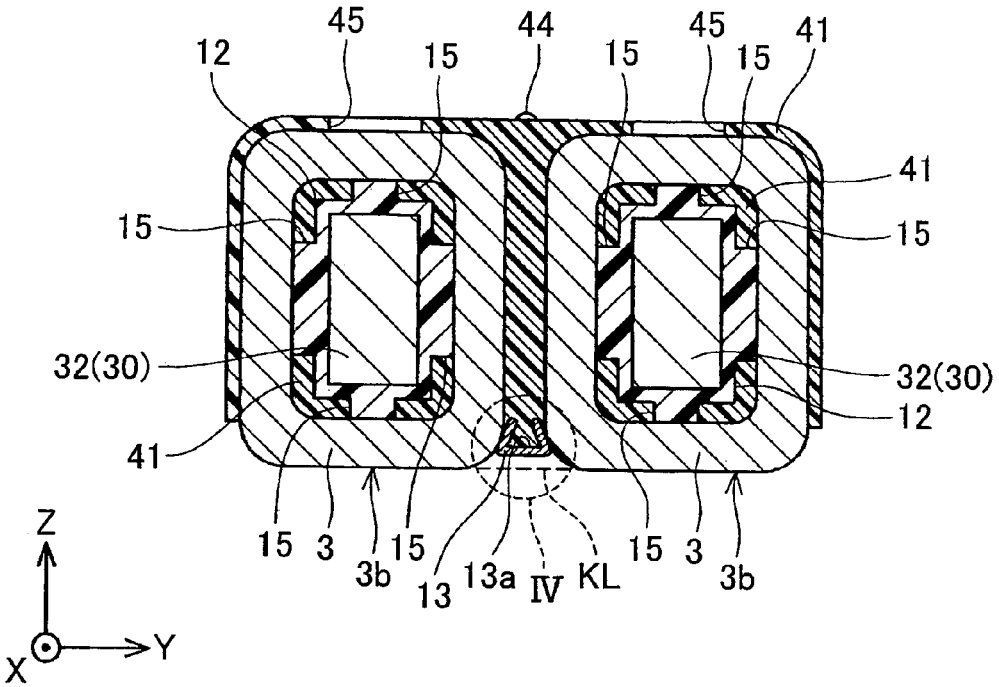
FIG. 3 is a cross-sectional view taken along a line of FIG. 2.

The column member 13 and the fitting hole 18*b* fitted thereto shown in FIG. 1 will be described. FIG. 3 shows a cross-section along a line III-III of FIG. 2. The column member 13 extends from the flange 19 as one of the flanges along the axes of the coils 3. A tip of the column member 13 is fitted to the fitting hole 18*b* of the other flange 10*b* (see FIG. 1). The column member 13 is made of the same resin as the bobbin 10. As shown in FIG. 3, the column member 13 is located in a space that is surrounded by a common tangential plane KL that is in contact with the lateral faces of the two coils 3 and the lateral faces of the two coils 3, and extends parallel to the coils 3. The column member 13 is embedded at an end of the resin cover 41 that fills a gap between the two coils 3. Besides, the column member 13 is equipped with a groove 13*a* that extends parallel to the coils 3 and opens in an orientation reverse to the common tangential plane KL. An interior of the groove 13*a* is filled with resin of the resin cover 41, and outer sides of lateral walls of the groove 13*a* abut on the lateral faces of the coils 3 respectively. This column member 13 closes the gap between the adjacent coils 3 so as to prevent molten resin from leaking out to the lower face sides of the coils between the two coils 3 during injection molding of the resin cover 41.

Figure 4:
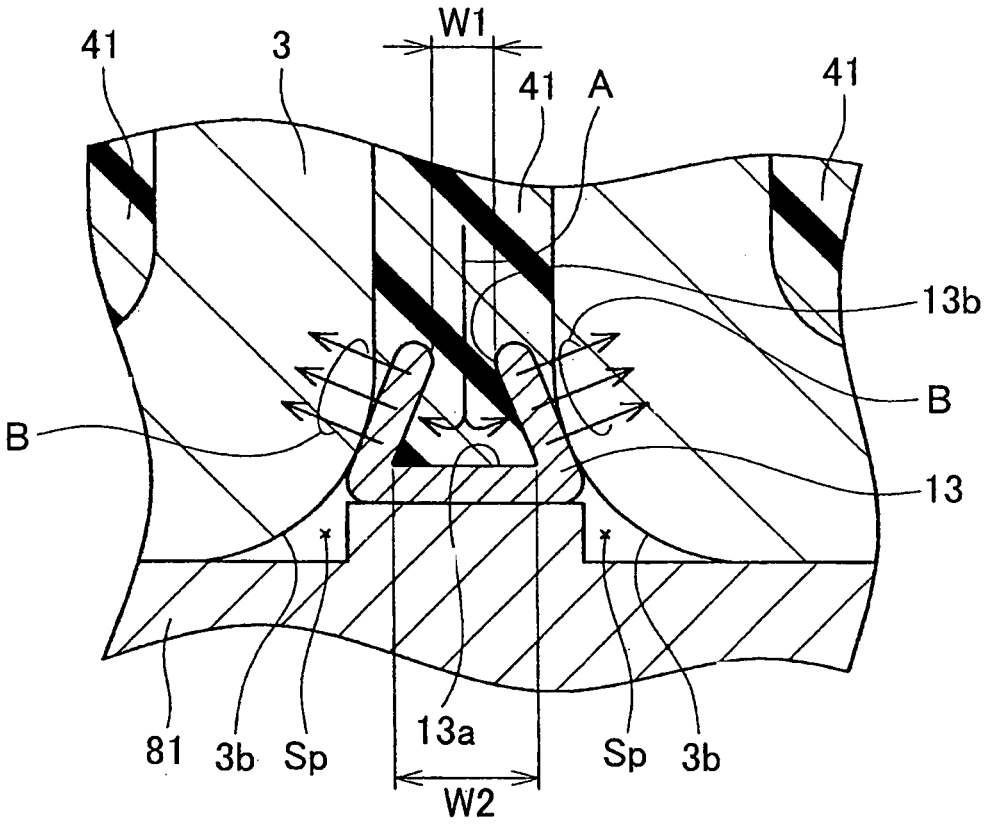
FIG. 4 is an enlarged view of a region surrounded by a broken line IV of FIG. 3.

FIG. 4 is an enlarged view showing a range indicated by a reference symbol IV in FIG. 3. FIG. 4 shows how the resin cover 41 is injection-molded, and a mold 81 is also depicted.

The groove 13*a* of the column member 13 has a width that widens from an opening 13*b* toward a bottom of the groove, in a cross-section of FIG. 4, namely, a cross-section that is perpendicular to the axes of the coils. In FIG. 4, a width W1 of the opening of the groove 13*a* is smaller than a width W2 of the bottom of the groove 13*a*.

An advantage of the column member 13 will be described. There is a gap Sp between the mold 81 and the coils 3, but the column member 13 closes up a lower end of the gap between the adjacent coils 3, along the lateral faces of the coils 3 and along the axes of the coils. As indicated by a gate trace 44 of the resin cover 41 in FIG. 3, the resin injection hole opens toward the opening 13*b* of the groove 13*a* of the column member 13 in the mold. Accordingly, as indicated by an arrow A of FIG. 4, molten resin flows downward from above through the gap between the adjacent coils 3 (flows toward the opening 13*b* of the groove 13*a*), and applies a pressure to the lateral walls of the groove inside the groove 13*a*. Then, as indicated by an arrow B of FIG. 4, both the lateral walls of the groove 13*a* are pressed against the adjacent coils 3 respectively. This causes the lateral faces of the coils 3 to adhere to the column member 13, and prevents resin from leaking to the gap Sp. That is, lower faces 3*b* of the coils 3 that are scheduled to be exposed are appropriately exposed. Incidentally, in a finished product, the groove 13*a* of the column member 13 is filled with the resin constituting the resin cover 41.

The column member 13 extends from the flange 19 as one of the flanges of the bobbin 10, and is engaged with the fitting hole 18*b* of the other flange (the second part 10*b*). Therefore, the column member 13 is supported at both ends thereof, and hence can well endure the pressure of resin during injection molding as well. Incidentally, a bottom face of the column member 13 (a face that is opposed to the common tangential plane KL in FIG. 3) is in contact with the mold 81, and therefore is supported by, the mold 81 as well.

Points to remember about the art described in the embodiment of the invention will be mentioned. The resinous column member 13 more effectively seals the gap between the coils than the metallic mold that closes up the gap between the adjacent coils 3. This is because of the following reason. The coils are assemblies of windings and the contour thereof does not exhibit high accuracy, and therefore, a gap may be formed therebetween in the metallic mold. In contrast, the resinous column member 13 is more flexible than the metal, and hence can be flexibly deformed in accordance with the dispersion of the contour of the coils. Thus, gaps are unlikely to be formed between the column member 13 and the coils.

Besides, the windings of the coils may be equipped with insulating coatings. However, if such coils firmly abut on the metallic mold, the insulating coatings may be damaged. The resinous column member 13 is also advantageous in that there is a low possibility of the insulating coatings being damaged.

In a situation where the reactor 2 is actually mounted, a radiator plate or a cooler is arranged in a region equivalent to the mold 81 of FIG. 4. The radiator plate or the cooler is in direct contact with the coils to cool the coils. The column member 13 appropriately secures the regions to be exposed of the lower faces 3*b* of the coils and the peripheries thereof. In the reactor 2 according to this embodiment of the invention, the resin cover is prevented from unintentionally narrowing the regions to be exposed, so that the heat radiation performance of the coils is not damaged. Incidentally, "the lower faces of the coils" are an appellation for the convenience of explanation, and the lateral faces of the coils that are to be exposed should not be limited to the lower faces.

The coils are not absolutely required to be substantially in the shape of a quadratic prism. The faces of the coils that are in contact with the cooler may be flat, and the other regions of the coils may be entirely or partially curved.

Although the concrete examples of the invention have been described above in detail, these are nothing more than exemplifications, and are not intended to limit the claims. The art set forth in the claims encompasses various modifications and alterations of the concrete examples exemplified above. The technical elements described in the present specification or the drawings are technically useful alone or in various combinations, and should not be limited to the combinations set forth in the claims at the time of the filing of the application. Besides, the art exemplified in the present specification or the drawings can achieve a plurality of objects at the same time, and is technically useful by achieving one of the objects in itself.

The invention claimed is:

1. A reactor comprising:

two coils that are arranged parallel to each other;

a resin cover that adheres to the two coils to cover the coils, the resin cover being configured to expose lateral faces of the respective coils on such a side as to be in contact with a common tangential plane; and a column member that is arranged parallel to coil axes in a space that is surrounded by the common tangential plane and the lateral faces of the respective coils, the column member being exposed on a side of the column member that is opposed to the common tangential plane and being in contact with the respective coils on a side of the column member that is not opposed to the common tangential plane, the column member having a groove that has an opening on an other side of the common tangential plane and extends along the coil axes, the groove having a width that widens from the opening toward a bottom of the groove, and an interior of the groove being filled with resin of the resin cover.

2. The reactor according to claim 1, wherein the column member is made of resin.

3. The reactor according to claim 1, wherein the resin cover is made through injection molding.

4. The reactor according to claim 3, wherein a gate trace during injection molding of the resin cover is located in a direction in which the opening of the column member is oriented.

* * * * *